11/21/78 XR 4,126,566

United States Patent [19]

Brown

[11] 4,126,566

[45] Nov. 21, 1978

[54] ELECTROSTATIC DEVELOPER MATERIAL

[75] Inventor: Robert W. Brown, Rochester, N.Y.

[73] Assignee: Xerox Corporation, Stamford, Conn.

[21] Appl. No.: 553,052

[22] Filed: Feb. 25, 1975

Related U.S. Application Data

[62] Division of Ser. No. 435,372, Jan. 21, 1974, Pat. No. 3,916,064.

[51] Int. Cl.[2] ..... G03G 9/10

[52] U.S. Cl. ..... 252/62.1 P; 96/15 D; 427/14; 428/408

[58] Field of Search ..... 96/15 D; 252/62.1 P; 427/62, 82, 123, 14, 20, 406, 407

[56] References Cited

U.S. PATENT DOCUMENTS

| | | | |
|---|---|---|---|
| 3,672,928 | 6/1972 | Madrid | 252/62.1 |
| 3,900,589 | 8/1975 | Lindblad | 96/15 D |

*Primary Examiner*—Roland E. Martin, Jr.
*Assistant Examiner*—John L. Goodrow

[57] ABSTRACT

An electrostatographic developer mixture comprising finely-divided toner particles electrostatically clinging to the surface of large carrier particles, each of the carrier particles comprising a core material surrounded by a matrix material containing solid, finely-divided particles having an average diameter less than about 10 microns wherein the solid, finely-divided particles comprise at least one compound selected from the group consisting of phthalic acid, isophthalic acid, terephthalic acid, the metal and ammonium salts thereof.

5 Claims, No Drawings

ELECTROSTATIC DEVELOPER MATERIAL

This is a division of application Ser. No. 435,372 filed Jan. 21, 1974, now U.S. Pat. No. 3,916,064.

BACKGROUND OF THE INVENTION

This invention relates in general to electrostatographic imaging systems, and, in particular, to improved developer materials and their use.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image a finely-divided electroscopic material referred to in the art as "toner". The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light and shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing step.

Many methods are known for applying the electroscopic particles to the electrostatic latent image to be developed. One development method, as disclosed by E. N. Wise in U.S. Pat. No. 2,618,552 is known as "cascade" development. In this method, developer material comprising relatively large carrier particles having finely-divided toner particles electrostatically clinging to the surface of the carrier particles is conveyed to and rolled or cascaded across the electrostatic latent image-bearing surface. The composition of the toner particle is so chosen as to have a triboelectric polarity opposite that of the carrier particles. In order to develop a negatively charged electrostatic latent image, an electroscopic powder and carrier combination should be selected in which the powder is triboelectrically positive in relation to the carrier. Conversely, to develop a positively charged electrostatic latent image, the electroscopic powder and carrier should be selected in which the powder is triboelectrically negative in relation to the carrier. This triboelectric relationship between the powder and carrier depends on their relative positions in a triboelectric series which the materials are arranged in such a way that each material is charged with a positive electrical charge when contacted with any material below it in the series and with a negative electrical charge when contacted with any material above it in the series. As the mixture cascades or rolls across the image-bearing surface, the toner particles are electrostatically deposited and secured to the charged portions of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier particles and unused toner particles are then recycled. This technique is extremely good for the development of line copy images. The cascade development process is the most widely used commercial electrostatographic development technique. A general purpose office copying machine incorporating this technique is described in U.S. Pat. No. 3,099,943.

Another technique for developing electrostatic images is the "magnetic brush" process as disclosed, for example, in U.S. Pat. No. 2,874,063. In this method a developer material containing toner and magnetic carrier particles is carried by a magnet. The magnetic field of the magnet causes alignment of the magnetic carriers in a brush-like configuration. This "magnetic brush" is engaged with an electrostatic latent image-bearing surface and the toner particles are drawn from the brush to the electrostatic image by electrostatic attraction. Many other methods such as "touchdown" development as disclosed by C. R. Mayo in U.S. Pat. No. 2,895,847 are known for applying electroscopic particles to the electrostatic latent image to be developed. The development processes as mentioned above together with numerous variations are well known to the art through various patents and publications and through the widespread availability and utilization of electrostatographic imaging equipment.

In automatic electrostatographic equipment, it is conventional to employ an electrostatographic plate in the form of a cylindrical drum which is continuously rotated through a cycle of sequential operations including charging, exposure, developing, transfer and cleaning. The plate is usually charged with corona with positive polarity by means of a corona generating device of the type disclosed by L. E. Walkup in U.S. Pat. No. 2,777,957 which is connected to a suitable source of high potential. After forming a powder image on the electrostatic image during the development step, the powder image is electrostatically transferred to a support surface by means of a corona generating device such as the corona device mentioned above. In automatic equipment employing a rotating drum, a support surface to which a powdered image is to be transferred is moved through the equipment at the same rate as the periphery of the drum and contacts the drum in the transfer position interposed between the drum surface and the corona generating device. Transfer is effected by the corona generating device which imparts an electrostatic charge to attract the powder image from the drum to the support surface. The polarity of charge required to effect image transfer is dependent upon the visual form of the original copy relative to the reproduction and the electroscopic characteristics of a developing material employed to effect development. For example, where a positive reproduction is to be made of a positive original, it is conventional to employ a positive polarity corona to effect transfer of a negatively charged toner image to the support surface. When a positive reproduction from a negative original is desired, it is conventional to employ a positively charged developing material which is repelled by the charged areas on the plate to the discharge areas thereon to form a positive image which may be transferred by negative polarity corona. In either case, a residual powder image and occasionally carrier particles remain on the plate after transfer. Before the plate may be reused for a subsequent cycle, it is necessary that the residual image and carrier particles, if any, be removed to prevent ghost images from forming on subsequent copies. In the positive-to-positive reproduction process described above, the residual developer powder as well as any carrier particles present are tightly retained on the plate surface by a phenomenon that is not fully understood but believed caused by an electric charge. The charge is substantially neutralized by means of a corona generating device prior to contact of the residual powder with a cleaning device. The neutralization of a charge enhances the cleaning efficiency of the cleaning device.

Typical electrostatographic cleaning devices include the "web" type cleaning apparatus as disclosed, for example, by W. P. Graff, Jr. et al in U.S. Pat. No. 3,186,838. In the Graff, Jr. et al patent, removal of the residual powder and carrier particles on the plate is effected by rubbing a web of fibrous material against the imaging plate surface. These inexpensive and disposable webs of fibrous material are advanced into pressure and rubbing or wiping contact with the imaging surface and are gradually advanced to present a clean surface to the plate whereby substantially complete removal of the residual powder and carrier particles from the plate is effected.

While ordinarily capable of producing good quality image, conventional developing systems suffer serious deficiencies in certain areas. In the reproduction of high contrast copies such as letters, tracings and the like, it is desirable to select the electroscopic powder and carrier materials so that their mutual electrification is relatively large; the degree of such electrification being governed in most cases by the distance between their relative positions in the triboelectric series. However, when otherwise compatible electroscopic powder and carrier materials are removed from each other in the triboelectric series by too great a distance, the resulting images are very faint because the attractive forces between the carrier and toner particles compete with the attractive forces between the electrostatic latent image and the toner particles. Although the image density described in the immediately preceding sentence may be improved by increasing the toner concentration in the developer mixture, undesirably high background toner deposition as well as increased toner impaction and agglomeration is encountered when the developer mixture is overtoned. The initial electrostatographic plate charge may be increased to improve the density of the deposited powder image, but the plate charge would ordinarily have to be excessively high in order to attract the electroscopic powder away from the carrier particle. Excessively high electrostatographic plate charges are not only undesirable because of the high power consumption necessary to maintain the electrostatographic plate at high potentials, but also because the high potential causes the carrier particles to adhere to the electrostatographic plate surface rather than merely roll across and off the electrostatographic plate surface. Print deletion and massive carry-over of carrier particles often occur when carrier particles adhere to reusable electrostatographic imaging surfaces. Massive carrier carry-over problems are particularly acute when the developer is employed in solid area coverage machines where excessive quantities of toner particles are removed from carrier particles thereby leaving many carrier particles substantially bare of toner particles. Further, adherence of carrier particles to reusable electrostatographic imaging surfaces promotes the formation of undesirable scratches on the surfaces during image transfer and surface cleaning operations. It is therefore apparent that many materials which otherwise have suitable properties for employment as carrier particles are unsuitable because they possess too high a triboelectric value. In addition, uniform triboelectric surface characteristics of many carrier surfaces are difficult to achieve with mass production techniques. Quality images are, in some instances almost impossible to obtain in high speed automatic machines when carriers having non-uniform triboelectric properties are employed. Although it may be possible to alter the triboelectric value of an insulating carrier material by blending the carrier material with another insulating material having a triboelectric value remote from the triboelectric value of the original carrier material, relatively larger quantities of additional material is necessary to alter the triboelectric value of the original carrier material. The addition of large quantities of material to the original carrier material to change the triboelectric properties thereof requires a major manufacturing operation and often undesirably alters the original physical characteristics of the carrier material. Further, it is highly desirable to control the triboelectric properties of carrier surfaces to accommodate the use of desirable toner compositions while retaining the other desirable physical characteristics of the carrier. The alteration of the triboelectric properties of a carrier by applying a surface coating thereon is a particularly desirable technique. With this technique, not only is it possible to control the triboelectric properties of a carrier made from materials having desirable physical characteristics, it is also possible to employ materials previously not suitable as a carrier. Thus, for example, a carrier having desirable physical properties with the exception of hardness, can be coated with a material having desirable hardness as well as other physical properties, rendering the resultant product more useful as a carrier.

Suitable coated and uncoated carrier materials for cascade, magnetic brush, and touchdown development are well known in the art. The carrier generally comprises any suitable solid material, provided that the carrier acquires a charge having an opposite polarity to that of the toner particles when brought in close contact with the toner particles so that the toner particles adhere to and surround the carrier. By proper selection of materials in accordance with their position in the triboelectric series, the polarities of their charge when the materials are mixed are such that the electroscopic toner particles adhere to and are coated on the surface of a carrier and also adhere to that portion of the electrostatic image bearing surface having a greater attraction for the toner than the carrier.

For carrier coating material to be useful in reversal development, it should have the proper triboelectric properties. A vinyl chloride-vinyl acetate copolymer, as disclosed by L. E. Walkup in U.S. Pat. No. 2,618,551, is used for coating a carrier for use in reversal development of positively charged images. However, this copolymer is not spaced far enough below many toner materials in the triboelectric series to provide high quality reversal images. Therefore, a dye is used to enhance the reversal character of the carrier coating. While the carrier prepared from this polymer-dye blend has utility, it also has disadvantages. Batch to batch uniformity is poor. High speed machines requiring high quality output have great difficulty when trying to use this carrier. The origin of these difficulties probably lies in the incomplete compatibility of the dye with the polymer and possibly may be due to leaching of the dye from the carrier coating composition. Thus, there is a continuing need for a better electrostatographic carrier and an improved method for forming same.

It is, therefore, an object of this invention to provide a carrier manufacturing technique and a resulting product which overcome the above-noted deficiencies.

It is another object of this invention to provide carrier beads which do not tend to stick to electrostatographic imaging surfaces.

It is still another object of this invention to provide a method for rapidly altering triboelectric values of a carrier material without markedly changing the physical and chemical properties of the original carrier material.

It is a further object of this invention to provide a carrier manufacturing technique for producing carriers having uniform triboelectric properties.

It is a still further object of this invention to render suitable many materials which were heretofore unsuitable as carrier materials.

It is still another object of this invention to provide coated carrier materials having controllable triboelectric characteristics.

It is still another object of this invention to provide improved developer materials which may be employed in electrostatographic reversal development.

A still further object of this invention is to provide improved developer materials having physical and chemical properties superior to those of known developer materials.

The foregoing objects and others are accomplished, generally speaking, by incorporating solid, finely-divided particles of at least one compound selected from the group consisting of phthalic acid, isophthalic acid, terephthalic acid, the metal and ammonium salts thereof in at least the surface of carrier substrates. The solid, finely-divided particles employed should preferably have a maximum average particle size of less than about 10 microns because less particles are necessary to alter the triboelectric value of the original carrier material, less difficulty is encountered in incorporating the particles into a carrier substrate and many important physical properties of the original carrier material such as adhesion is substantially unaffected by the additional material. Although the actual mechanism is not entirely clear, the relative position of a specific carrier material in the triboelectric series is changed when the aforementioned solid, finely-divided particles are incorporated in at least the surface of the carrier substrate.

A mixture of any two or more of these phthalic acids and/or salts may be incorporated in the carrier materials of this invention. For convenience and brevity, the expression "additive" will be used herein to refer to such phthalic acid, isophthalic acid, terephthalic acid, and the metal and ammonium salts thereof.

Factors affecting the quantity of additive particles to be incorporated in at least the surface of carrier particles include; the separation in the triboelectric series between the electroscopic marking particles and the carrier material; the average particle size of the additive; the concentration of the additive particles at the surface of the carrier particle; the average diameter of the carrier particle; and the conductivity of the finely-divided additive particles.

The finely-divided additive particles may be distributed only at the surface of a coated or uncoated carrier particle or uniformly distributed throughout an uncoated carrier particle or throughout the external coating of a coated carrier particle. When the finely-divided additive particles are dispersed throughout the carrier particle or carrier particle coating rather than only contiguous to the surface of the carrier particle, proportionally more finely-divided additive particles must necessarily be employed in order to maintain a sufficient quantity of exposed additive particles at the surface of the carrier particle. The additional amount of finely-divided additive particles necessary depends to a large extent on the surface area of the carrier particles, hence, upon the particle diameter selected. Obviously, as the quantity of additive particles actually available at the surface of the carrier particle is reduced to a negligible amount, the triboelectric properties of the carrier surface are substantially the same as a carrier which does not contain additive particles. Obviously, with a given quantity of additive particles based on the weight of the carrier, a greater volume of additive particles is available at the surface of the carrier when the additive particles are located only at the surface of the carrier particles than when the particles are intimately dispersed throughout each carrier particle.

Because terephthalic acid is considerably more effective than either phthalic acid, isophthalic acid, or its own metal and ammonium salts and the metal or ammonium salts of phthalic acid and isophthalic acid, it is the preferred additive of the present invention. It is intended by the phrases metal salts and ammonium salts of phthalic acid, isophthalic acid and terephthalic acid to describe the monovalent mono- or dicarboxylates of said acids. In addition, in the case of di- or polyvalent metals, such acid salts include the carboxylates of one or more acid molecules. Representative of some of these metals are the alkali metals—lithium, sodium, potassium, rubidium, cesium; and the alkaline earth metals—magnesium, calcium, strontium, barium. Salt forming metals of the above acids also include such elements as zinc, tin, cadmium, aluminum, $Fe^{+++}$, cobalt, lead, silver, $Cu^{++}$, and nickel.

In a preferred embodiment, the finely-divided additive particles are incorporated into at least the outer surface of coated or uncoated carrier beads by bringing the finely-divided additive particles into contact with the soft hardenable external surface of coated or uncoated beads and impacting the additive particles therein by causing other beads to collide and roll across the soft surface thereof. As disclosed in copending application Ser. No. 113,101, filed Feb. 5, 1971, now abandoned, each carrier bead is subjected to thousands of collisions and rolling contacts with other beads during the impaction treatment. This impaction treatment is effected by suitable techniques such as tumbling a mixture of finely-divided additive particles and carrier beads having a soft surface in hollow rotating cylinders; vibrating a mixture of finely-divided additive particles and carrier beads having a soft surface linearly in high frequency reciprocating chambers; and contacting finely-divided particles with the soft external surfaces of carrier beads in an arcuate chamber vibrating in an oscillatory direction.

Where the finely-divided additive particles are to be incorporated into a carrier bead having a preformed soft outer surface which is capable of being subsequently hardened, the carrier bead or carrier bead coating should comprise a material such as a soft curable prepolymer resin, gelled plastisol or certain softened materials. The softened materials may comprise materials softened by heat or solvents. The solvent or heat softenable materials may include natural resins, thermoplastic resins, and hard partially cured thermosetting resins. The soft curable pre-polymers may comprise any suitable polymerized thermoplastic or thermosetting resin. Typical natural resins include: caoutchouc, colophony, copal, dammar, Dragon's Blood, jalap, storax, and the like. Typical thermoplastic resins include: the polyolefins such as polyethylene, polypropylene, chlorinated polyethylene, and chlorosulfonated polyethylene, polyvinyls and polyvinylidenes such as polystyrene, polymethylstyrene, polymethyl methacrylate, polyacrylonitrile, polyvinyl acetate, polyvinyl alcohol, polyvinyl butyral, polyvinyl chloride, polyvinyl carbazole, polyvinyl ethers, and polyvinyl ketones; fluorocarbons such as polytetrafluoroethylene, polyvinyl fluoride, polyvinylidene fluoride; and polychlorotrifluoroethylene; polyamides such as polycaprolactam and polyhexamethylene adipamide; polyesters such as polyethylene terephthalate; polyurethanes; polysulfides; polycarbonates; and the like. Typical thermosetting resins include: phenolic resins such as phenol-formaldehyde, phenol-furfural and resorcinol formaldehyde; amino resins such as urea-formaldehyde and melamine-formaldehyde; polyester resins; epoxy resins; and the like.

Where the finely-divided additive particles are impacted into a softened surface of a carrier bead or carrier bead coating, the carrier surface is preferably a heat or solvent softenable material. The quantity of heat energy or solvent employed to soften the carrier surface should not exceed that quantity necessary to soften the carrier coating to a tacky or highly viscous state. When excessive quantities of heat energy or solvent is applied to the carrier coating, the coating material tends to flow and collect on the treatment chamber walls and, in some cases, cause agglomeration of the carrier particles. Thus, it is preferred that substantial fluidization of the coating is avoided during the impaction process. The carrier beads may be heated or treated with solvent prior to, during and/or subsequent to placement in the treatment chamber. Heating of the carrier beads may be effected by convection, conduction and/or radiation. Generally, heating by convection or radiation is preferred for softening carrier coatings because the danger of coating removal by hot heat transfer surfaces is eliminated. Conventional hot air blower systems and/or infrared heater banks may be employed to heat the carrier particles. Solvents or partial solvents may be used to soften the external surface of the bead. Generally, greater control of the softening process is achieved when solvent vapors or partial solvents for the coating material are employed. The use of solvents which rapidly dissolve external bead surface materials is less desirable because uniform surface softening of all the beads is difficult to attain, particularly at temperatures at which the solvents are most effective. Since the additive particles to be incorporated into the bead surfaces are solids, care must be taken in selecting a solvent which will not completely dissolve the additive particles. Any suitable solute bead material and solvent combination may be employed. Solvents for the solvent soluble beads or bead coatings employable in this invention are available in most handbooks of chemistry. Typical combinations of bead solute and solvent include: styrene- methylmethacrylate-vinyl triethoxy silane terpolymer and toluene; polycarbonate and methylene chloride; phenoxy and tetrahydrofuran; nitrocellulose and methyl ethyl ketone; and the like.

Alternatively, the finely-divided additive particles of this invention may be dispersed or suspended throughout a carrier bead or carrier bead coating material prior to bead or bead coating formation. The dispersion or suspension may be prepared by conventional techniques. It is to be understood that the material employed to form the matrix of the carrier bead or carrier bead coating may be in any suitable form such as a hot melt, a solution, an emulsion, a liquid monomer or a dispersion. When the ultimate product is to be a coated carrier bead, the carrier coating compositions with or without the finely-divided additive particles may be applied to a carrier core by any conventional method such as spraying, dipping, fluidized bed coating, tumbling, brushing and the like. The coating compositions may be applied as a powder, a dispersion, solution, emulsion or hot melt. When applied as a solution, any suitable solvent may be employed. Solvents having relatively low boiling points are preferred because less energy and time is required to remove the solvent subsequent to application of the coating to the carrier core. If desired, the coating may comprise resin monomers which are polymerized in situ on the surface of the bead cores or plastisols gelled in situ to a nonflowable state on the surface of the bead cores. Any suitable coating thickness may be employed. However, the carrier coating should be sufficiently thick to resist flaking and chipping.

Any suitable well known coated or uncoated electrostatographic carrier bead material may be employed as the core of the beads of this invention. Tupical carrier core materials include sodium chloride, ammonium chloride, aluminum potassium chloride, Rochelle salt, sodium nitrate, potassium chlorate, granular zircon granular silicon, methyl methacrylate, glass silicon dioxide, flintshot, iron, steel ferrite, nickel, Carborundum, and mixtures thereof. Many of the foregoing and other typical carriers are described by L. E. Walkup in U.S. Pat. No. 2,618,551; L. E. Walkup et al, in U.S. Pat. No. 2,638,416 and E. N. Wise in U.S. Pat. No. 2,618,552. An ultimate homogeneous or coated carrier bead diameter between about 30 microns to about 1,000 microns is preferred for electrostatographic use because the treated carrier bead then possesses sufficient density and inertia to avoid adherence to the electrostatic latent image during the cascade or magnetic brush development process.

Generally, an average additive particle diameter of less than about 10 microns is preferred because the smooth surface of the ultimate treated bead is substantially uninterrupted by portions of relatively large diameter additive particles extending above the external bead surface. Optimum surface characteristics and maximum alteration of triboelectric value are achieved with additive particles having an average particle size of less than about 100 millimicrons. Although the unexposed additive particles remote from the external surfaces of carrier beads contribute in some cases to the density of the carrier, they do not appear to have any measurable effect on the carrier triboelectric properties. Thus, where high density matrices are employed, a monolayer of particles adjacent the external surface of a carrier or a gradient of particles comprising a dense region of particles adjacent the external surface of the carrier is preferred because less additive material is consumed.

Further, where the carrier bead is coated, maximum adhesion between the bead core and the coating layer is maintained with monolayers or gradients of additive particles adjacent the external surface of the coating.

Any suitable pigmented or dyed electroscopic toner material may be employed with the treated carriers of this invention. Typical toner materials include: gum sandarac, rosin, cumaroneindene resin, asphaltum, gilsonite, phen-formaldehyde resins, methacrylic resins, polystyrene resins, polypropylene resins, epoxy resins, polyethylene resins, and mixtures thereof. The particular toner material to be employed obviously depends upon the separation of the toner particles from the treated carrier beads in the triboelectric series. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. Re. No. 25,136 to Carlson and U.S. Pat. No. 2,788,288 to Rheinfrank et al. These toners generally have an average particle diameter between about 1 and about 30 microns.

Any suitable toner concentration may be employed with the treated carriers of this invention. Typical toner concentrations for cascade and magnetic brush development systems include about 1 part toner with about 10 to about 400 parts by weight of carrier.

Any suitable colorant such as a pigment or dye may be employed to color the toner particles. Toner colorants are well known and include, for example, carbon black, nigrosine dye, aniline blue, Calco Oil Blue, chrome yellow, ultramarine blue, Quinoline Yellow, methylene blue chloride, Monastral Blue, Malachite Greene Ozalate, lampblack, Rose Bengal, Monastral Red, Sudan Black BM, and mixtures thereof. The pigment or dye should be present in the toner in a sufficient quantity to render it highly colored so that it will form a clearly visible image on a recording member. Preferably, the pigment is employed in an amount from about 3 percent to about 20 percent, by weight, based on the total weight of the colored toner because high quality images are obtained. If the toner colorant employed is a dye, substantially smaller quantities of colorant may be used.

Any suitable organic or inorganic photoconductive material may be employed as the recording surface with the treated carriers of this invention. Typical inorganic photoconductor materials include: sulfur, selenium, zinc sulfide, zinc oxide, zinc cadmium sulfide, zinc magnesium oxide, cadmium selenide, zinc silicate, calcium strontium sulfide, cadmium sulfide, mercuric iodide, mercuric oxide, mercuric sulfide, indium trisulfide, gallium selenide, arsenic disulfide, arsenic trisulfide, arsenic triselenide, antimony trisulfide, cadmium sulfoselenide and mixtures thereof. Typical organic photoconductors include: guinacridone pigments, phthalocyanine pigments, triphenylamine, 2,4-bis(4,4'-diethylamino-phenol)-1,3,4-oxadiazol, N-isopropylcarbazol, triphenylpyrrol, 4,5-diphenylimidazolidinone, 4,5-diphenyl-imidazolidinethione, 4,5-bix-(4'-aminophenyl)-imidazolidinone, 1,5-dicyanonaphthalene, 1,4-dicyanonaphthalene, aminophthalodinitrile, nitrophthalodinitrile, 1,2,5,6-tetraazacyclooctatetraene-(2,4,6,8), 2-mercaptobenzothiazole-2-phenyl-4-diphenylidene-oxazolone, 6-hydroxy-2,3-di(p-methoxyphenyl)-benzofurane, 4-dimethylaminobenzylidene-benzhydrazide, 3-benzylidene-amino-carbazole, polyvinyl carbazole, (2-nitro-benzylidene)-p-bromoaniline, 2,4-diphenylquinazoline, 1,2,4-triazine, 5-diphenyl-3-methyl-pyrazoline, 2-(4'dimethylamino phenyl)-benzoxazole, 3-amine-carbazole, and mixtures thereof. Representative patents in which photoconductive materials are disclosed include U.S. Pat. Nos. 2,8,803,542 to Ullrich, U.S. Pat. No. 2,970,906 to Bixby, U.S. Pat. No. 3,121,006 to Middleton, U.S. Pat. No. 3,121,007 to Middleton, and U.S. Pat. No. 3,151,982 to Corrsin.

The following examples further define, describe and compare methods of preparing the carrier materials of the present invention and of utilizing them to develop electrostatic latent images. Parts and percentages are by weight unless otherwise indicated.

In the following, the relative triboelectric values generated by contact of carrier beads with toner particles is measured by means of a Faraday Cage. The device comprises a brass cylinder having a diameter of one inch and a length of one inch. A 100-mesh screen is positioned at each end of the cylinder. The cylinder is weighed, charged with 0.5 gram of a mixture of carrier and toner particles and connected to ground through a capacitor and an electrometer connected in parallel. Dry compressed air is then blown through the brass cylinder to drive all the toner from the carrier. The charge on the capacitor is then read on the electrometer. Next, the chamber is reweighed to determine the weight loss. The resulting data is used to calculate the toner concentration and the charge in micro-coulombs per gram of toner. Since triboelectric measurements are relative, the measurements should, for comparative purposes, be conducted under substantially identical conditions. Thus, a toner comprising a styrene-n-butyl methacrylate copolymer, polyvinyl butyral, and carbon black by the method disclosed by M. A. Insalaco in Example 1 of U.S. Pat. No. 3,079,342 is used as a contact triboelectrification standard in all the examples. Obviously other suitable toners such as those listed above may be substituted for the toner used in the examples.

EXAMPLE I

A control sample is produced by mixing about 0.5 part colored styrene copolymer toner particles having an average particle size of about 10 to about 20 microns with about 100 parts coated carrier particles having an average particle size of about 450 microns. The carrier comprises steel bead cores coated with a vinyl chloride-maleic ester-carboxylic acid terpolymer (Exon 470, available from Firestone Plastics Company, Pottstown, Pa.). About 0.4 pound of carrier coating material is applied to about 100 pounds of carrier core material. The relative triboelectric value of the carrier measured by means of a Faraday Cage is about −11.5, −9.7, and −4.8 micro-coulombs per gram of toner after the developer mixture had been mixed on a three roll mill for about 10, 30, and 180 minutes, respectively.

EXAMPLE II

A developer sample is produced by mixing about 0.5 part colored styrene copolymer toner particles of the type described in Example I with about 100 parts coated carrier particles having an average particle size of about 450 microns. The carrier coating comprises the same type of terpolymer as described in Example I but containing about 10 percent by weight, based on the weight of the terpolymer, of terephthalic acid (EK 640, available from Eastman Kodak Co., Rochester, N.Y.) particles having an average particle size of between about 1 micron and 3 microns. The coating composition is prepared by dispersing the terephthalic acid particles into a methyl isobutyl ketone solution of the terpolymer. A milky white dispersion is obtained. About 0.4 pound, based on the weight of the terpolymer and the terephthalic acid, of the carrier coating composition is applied to about 100 pounds of steel cores via conventional coating techniques. The terephthalic acid particles are believed to exist as a finely dispersed solid in the polymeric coating matrix of the carrier. The relative triboelectric value of the carrier measured by means of a Faraday Cage is about −17.4, −15.6, and −9.9 microcoulombs per gram of toner after the developer mixture had been mixed on a three roll mill for about 10, 30, and 180 minutes, respectively.

EXAMPLE III

A developer sample is produced by mixing about 0.5 part colored styrene copolymer toner particles of the type described in Example I with about 100 parts coated carrier particles having an average particle size of about 450 microns. The carrier coating comprises the same type of terpolymer as described in Example I but containing about 15 percent by weight, based on the weight of the terpolymer, of terephthalic acid (EK 640, available from Eastman Kodak Co., Rochester, N.Y.) particles having an average particle size of between about 1 micron and 3 microns. The coating composition is prepared by dispersing the terephthalic acid particles into a methyl isobutyl ketone solution of the terpolymer. A milky white dispersion is obtained. About 0.4 pound, based on the weight of the terpolymer and the terephthalic acid, of the carrier coating composition is applied to about 100 pounds of steel cores via conventional coating techniques. the terephthalic acid particles are believed to exist as a finely dispersed solid in the polymeric coating matrix of the carrier. The relative triboelectric value of the carrier measured by means of a Faraday Cage is about −21.1, −17.2, and −9.4 microcoulombs per gram of toner after the developer mixture had been mixed on a three roll mill for about 1, 30, and 180 minutes, respectively.

EXAMPLE IV

A developer sample is produced by mixing about 0.5 part colored styrene copolymer toner particles of the type described in Example I with about 100 parts coated carrier particles having an average particle size of about 450 microns. The carrier coating comprises the same type of terpolymer as described in Example I but containing about 20 percent by weight, based on the weight of the terpolymer, of terephthalic acid (EK 640, available from Eastman Kodak, Co., Rochester, N.Y.) particles having an average particle size of between about 1 micron and 3 microns. The coating composition is prepared by dispersing the terephthalic acid particles into a methyl isobutyl ketone solution of the terpolymer. A milky white dispersion is obtained. About 0.4 pound, based on the weight of the terpolymer and the terephthalic acid, of the carrier coating composition is applied to about 100 pounds of steel cores via conventional coating techniques. The terephthalic acid particles are believed to exist as a finely dispersed solid in the polymeric coating matrix of the carrier. The relative triboelectric value of the carrier measured by means of a Faraday Cage is about −23.0, −16.3, and −10.8 microcoulombs per gram of toner after the developer mixture had been mixed on a three roll mill for about 10, 30, and 180 minutes, respectively.

EXAMPLE V

A control sample is produced by mixing about one part colored styrene copolymer toner particles of the type described in Example I with about 100 parts coated carrier particles having an average particle size of about 450 microns. The carrier comprises steel bead cores coated with the addition reaction product of about 15 parts styrene, about 85 parts methyl methacrylate, and about 5 parts vinyl triethoxysilane. About 1 pound of carrier coating material is applied to about 100 pounds of carrier core material. The relative triboelectric value of the carrier measured by means of a Faraday Cage is about 29 micro-coulombs per gram of toner.

EXAMPLE VI

A developer sample is produced by mixing about one part colored styrene copolymer toner particles of the type described in Example I with about 100 parts coated carrier particles having an average particle size of about 450 microns. The carrier coating comprises the same type of addition reaction product described in Example V but containing about 10 percent by weight, based on the weight of the addition reaction product, of terephthalic acid (EK 640, available from Eastman Kodak Co., Rochester, N.Y.) particles having an average particle size of between about 1 micron and 3 microns. The coating composition is prepared by dispersing the terephthalic acid particles into a methyl isobutyl ketone solution of the addition reaction product. A milky white dispersion is obtained. About 0.4 pound, based on the weight of the addition reaction product and the terephthalic acid, of the carrier coating composition is applied to about 100 pounds of steel cores via conventional coating techniques. The terephthalic acid particles are believed to exist as a finely dispersed solid in the polymeric coating matrix of the carrier. The relative triboelectric value of the carrier measured by means of a Faraday Cage is about 24.0 micro-coulombs per gram of toner.

EXAMPLE VII

A developer sample is produced by mixing about one part colored styrene copolymer toner particles of the type described in Example I with about 100 parts coated carrier particles having an average particle size of about 450 microns. The carrier coating comprises the same type of addition reaction product described in Example V but containing about 15 percent by weight, based on the weight of the addition reaction product, of terephthalic acid (EK 640, available from Eastman Kodak Co., Rochester, N.Y.) particles having an average particle size of between about 1 micron and 3 microns. The coating composition is prepared by dispersing the terephthalic acid particles into a methyl isobutyl ketone solution of the addition reaction product. A milky white dispersion is obtained. About 0.4 pound, based on the weight of the addition reaction product and the terephthalic acid, of the carrier coating composition is applied to about 100 pounds of steel cores via conventional coating techniques. The terephthalic acid particles are believed to exist as a finely dispersed solid in the polymeric coating matrix of the carrier. The relative triboelectric value of the carrier measured by means of a Faraday Cage is about 21.0 micro-coulombs per gram of toner.

EXAMPLE VIII

A developer sample is produced by mixing about one part colored styrene copolymer toner particles of the type described in Example I with about 100 parts coated carrier particles having an average particle size of about 450 microns. The carrier coating comprises the same type of addition reaction product described in Example V but containing about 20 percent by weight, based on the weight of the addition reaction product, of terephthalic acid (EK 640, available from Eastman Kodak Co., Rochester, N.Y.) particles having an average particle size of between about 1 micron and 3 microns. The coating composition is prepared by dispersing the terephthalic acid particles into a methyl isobutyl ketone solution of the addition reaction product. A milky white dispersion is obtained. About 0.4 pound, based on the weight of the addition reaction product and the terephthalic acid, of the carrier coating composition is applied to about 100 pounds of steel cores via conventional coating techniques. The terephthalic acid particles are believed to exist as a finely dispersed solid in the polymeric coating matrix of the carrier. The relative triboelectric value of the carrier measured by means of a Faraday Cage is about 20.0 micro-coulombs per gram of toner.

EXAMPLE IX

A control sample is produced by mixing about one part colored styrene copolymer toner particles of the type described in Example I with about 100 parts coated carrier particles having an average particle size of about 250 microns. The carrier comprises a glass bead core coated with the same type of terpolymer as described in Example I. About 1 pound of carrier coating material is applied to about 100 pounds of carrier core material. The relative triboelectric value of the carrier measured by means of a Faraday Cage is about −12.1 micro-coulombs per gram of toner.

EXAMPLE X

A developer sample is produced by mixing about one part colored styrene copolymer toner particles of the type described in Example I with about 100 parts coated carrier particles having an average particle size of about 250 microns. The carrier coating comprises the same type of terpolymer as described in Example IX but containing about 10 percent by weight, based on the weight of the terpolymer, of terephthalic acid (EK 640, available from Eastman Kodak Co., Rochester, N.Y.) particles having an average particle size of between about 1 micron and 3 microns. The coating composition is prepared by dispersing the terephthalic acid particles into a methyl isobutyl ketone solution of the terpolymer. A milky white dispersion is obtained. About 0.4 pound, based on the weight of the terpolymer and the terephthalic acid, of the carrier coating composition is applied to about 100 pounds of glass cores via conventional coating techniques. The terephthalic acid particles are believed to exist as a finely dispersed solid in the polymeric coating matrix of the carrier. The relative triboelectric value of the carrier measured by means of a Faraday Cage is about −19.0 micro-coulombs per gram of toner.

EXAMPLE XI

A developer sample is produced by mixing about one part colored styrene copolymer toner particles of the type described in Example I with about 100 parts coated carrier particles having an average particle size of about 250 microns. The carrier coating comprises the same type of terpolymer as described in Example IX but containing about 15 percent by weight, based on the weight of the terpolymer, of terephthalic acid (EK 640, available from Eastman Kodak Co., Rochester, N.Y.) particles having an average particle size of between about 1 micron and 3 microns. The coating composition is prepared by dispersing the terephthalic acid particles into a methyl isobutyl ketone solution of the terpolymer. A milky white dispersion is obtained. About 0.4 pound, based on the weight of the terpolymer and the terephthalic acid, of the carrier coating composition is applied to about 100 pounds of glass cores via conventional coating techniques. The terephthalic acid particles are believed to exist as a finely dispersed solid in the polymeric coating matrix of the carrier. The relative triboelectric value of the carrier measured by means of a Faraday Cage is about −23.0 micro-coulombs per gram of toner.

EXAMPLE XII

A developer sample is produced by mixing about one part colored styrene copolymer toner particles of the type described in Example I with about 100 parts coated carrier particles having an average particle size of about 250 microns. The carrier coating comprises the same type of terpolymer as described in Example I but containing about 20 percent by weight, based on the weight of the terpolymer, of terephthalic acid (EK 640, available from Eastman Kodak Co., Rochester, N.Y.) particles having an average particle size of between about 1 micron and 3 microns. The coating composition is prepared by dispersing the terephthalic acid particles into a methyl isobutyl ketone solution of the terpolymer. A milky white dispersion is obtained. About 0.4 pound, based on the weight of the terpolymer and the terephthalic acid, of the carrier coating composition is applied to about 100 pounds of glass cores via conventional coating techniques. The terephthalic acid particles are believed to exist as a finely dispersed solid in the polymeric coating matrix of the carrier. The relative triboelectric value of the carrier measured by means of a Faraday Cage is about −24.0 micro-coulombs per gram of toner.

EXAMPLE XIII

A control sample is produced by mixing one part colored styrene copolymer toner particles of the type described in Example I with about 100 parts coated carrier particles having an average particle size of about 600 microns. The carrier coating comprises the same type of terpolymer as described in Example I but containing about 25 percent by weight, based on the weight of the terpolymer, of Luxol Fast Blue Dye. About 0.3 pound of the coating material is applied to about 100 pounds of steel cores. The terephthalic acid particles are believed to exist as a finely dispersed solid in the polymeric coating matrix of the carrier. The relative triboelectric value of the carrier measured by means of a Faraday Cage is about −12 micro-coulombs per gram of toner.

EXAMPLE XIV

A developer sample is produced by mixing about one part colored styrene copolymer toner particles of the type described in Example I with about 100 parts of a portion of the coated carrier particles described in Example XIII. The carrier coating is impacted with about 10 percent by weight, based on the weight of the carrier coating material, of terephthalic acid (EK 640, available from Eastman Kodak Co., Rochester, N.Y.) particles having an average particle size of between about 1 micron and 3 microns. The terephthalic acid particles are impacted into the carrier coating in a vibrating housing. The impaction process involves softening the carrier coating and vibrating the coated carrier particles and terephthalic acid particles at an oscillatory vibration frequency of about 2,000 cycles per minute. The vibration is maintained until the housing no longer contains free terephthalic acid particles. The terephthalic acid particles are believed to exist as a finely dispersed solid in the polymeric coating matrix of the carrier. The relative triboelectric value of the impacted carrier particles measured by means of a Faraday Cage is about −17.0 micro-coulombs per gram of toner.

EXAMPLE XV

A control sample is produced by mixing about 0.5 part colored styrene copolymer toner particles of the type described in Example I having an average particle size of between about 10 to about 20 microns with about 100 parts coated carrier particles having an average particle size of about 250 microns. The carrier comprises steel bead cores coated with a polyvinyl chloride terpolymer comprising about 86 parts vinyl chloride, about 13 parts vinyl acetate, and about 1 part maleic acid (VMCH, available from Union Carbide Corp., New York, N.Y.). About 0.4 pound of carrier coating material is applied to about 100 pounds of carrier core material. The relative triboelectric value of the carrier measured by means of a Faraday Cage is about −5.7, −5.6 and −5.2 micro-coulombs per gram of toner after the developer mixture had been mixed on a three roll mill for about 10, 30, and 180 minutes, respectively.

EXAMPLE XVI

A developer sample is produced by mixing about 0.5 part colored styrene copolymer toner particles of the type described in Example XV with about 100 parts coated carrier particles having an average particle size of about 250 microns. The carrier coating comprises the same type of polyvinyl chloride terpolymer as described in Example XV but containing about 20 percent by weight, based on the weight of the terpolymer, of particles of the stannous salt of terephthalic acid having an average particle size of between about 1 micron and 10 microns. The coating composition is prepared by dispersing the particles of the stannous salt of terephthalic acid into a methyl ethyl ketone solution of the polyvinyl chloride terpolymer. A milky white dispersion is obtained. About 0.4 pound, based on the weight of the terpolymer and the terephthalic acid salt, of the carrier coating composition is applied to about 100 pounds of steel cores via conventional coating techniques. The terephthalic acid salt particles are believed to exist as a finely dispersed solid in the polymeric coating matrix of the carrier. The relative triboelectric value of the carrier measured by means of a Faraday Cage is about −20.1, −28.8, and −28.0 micro-coulombs per gram of toner after the developer mixture had been mixed on a three roll mill for about 10, 30, and 180 minutes, respectively.

EXAMPLE XVII

A developer sample is produced by mixing about 0.5 part colored styrene copolymer toner particles of the type described in Example XV with about 100 parts coated carrier particles having an average particle size of about 250 microns. The carrier coating comprises the same type of polyvinyl chloride terpolymer as described in Example XV but containing about 20 percent by weight, based on the weight of the terpolymer, of particles of isophthalic acid having an average particle size of between about 1 micron and 10 microns. The coating composition is prepared by dispersing the particles of the stannous salt of terephthalic acid into a methyl ethyl ketone solution of the polyvinyl chloride terpolymer. A milky white dispersion is obtained. About 0.4 pound, based on the weight of the terpolymer and the terephthalic acid salt, of the carrier coating composition is applied to about 100 pounds of steel cores via conventional coating techniques. The terephthalic acid salt particles are believed to exist as a finely dispersed solid in the polymeric coating matrix of the carrier. The relative triboelectric value of the carrier measured by means of a Faraday Cage is about −16.8, −21.4, and −26.7 micro-coulombs per gram of toner after the developer mixture had been mixed on a three roll mill for about 10, 30, and 180 minutes, respectively.

Although specific components, proportions and procedures have been stated in the above description of the preferred embodiments of the novel carrier system, other suitable materials, as listed above, may be used with similar results. Further, other materials and procedures may be employed to synergize, enhance or otherwise modify the novel system.

Other modifications and ramifications of the present invention will appear to those skilled in the art upon the reading of a disclosure. These are intended to be included within the scope of this invention.

What is claimed is:

1. A developer composition for an imaging surface bearing an electrostatic latent image comprising a dry mixture of finely-divided electrostatically attractable toner particles and a plurality of freely movable carrier particles, said carrier particles having an average diameter of between about 30 microns and about 1,000 microns and comprising a core surrounded by an outer coating of matrix material and solid finely-divided particles of at least one compound selected from the group consisting of phthalic acid, isophthalic acid, terephthalic acid, and the metal and ammonium salts thereof having an average diameter less than about 10 microns substantially uniformly dispersed throughout said outer coating.

2. A developer composition in accordance with claim 1 wherein said core comprises glass.

3. A developer composition for an imaging surface bearing an electrostatic latent image comprising a dry mixture of finely-divided electrostatically attractable toner particles and a plurality of freely movable carrier particles, said carrier particles having an average diameter of between about 30 microns and about 1,000 microns and comprising a core surrounded by an outer coating of matrix material and solid finely-divided particles of at least one compound selected from the group consisting of phthalic acid, isophthalic acid, terephthalic acid, and the metal and ammonium salts thereof having an average diameter less than about 10 microns concentrated contiguous to the outer surface of said outer coating.

4. A developer composition for an imaging surface bearing an electrostatic latent image comprising a dry mixture of finely-divided electrostatically attractable toner particles and a plurality of freely movable carrier particles, said carrier particles having an average diameter of between about 30 microns and about 1,000 microns and comprising a core overcoated with matrix material and solid finely-divided particles of at least one compound selected from the group consisting of phthalic acid, isophthalic acid, terephthalic acid, and the metal and ammonium salts thereof having an average diameter less than about 10 microns substantially uniformly dispersed throughout said matrix material.

5. A developer composition for an imaging surface bearing an electrostatic latent image comprising a dry mixture of finely-divided electrostatically attractable toner particles and a plurality of freely movable carrier particles, said carrier particles having an average diameter of between about 30 microns and about 1,000 microns and comprising a core having substantially uniformly distributed throughout said core solid finely-divided particles of at least one compound selected from the group consisting of phthalic acid, isophthalic acid, terephthalic acid, and the metal and ammonium salts thereof having an average diameter less than about 10 microns.

* * * * *